United States Patent [19]

Knapp et al.

[11] Patent Number: 4,695,524

[45] **Date of Patent: * Sep. 22, 1987**

[54] PROCESS FOR ULTRA HIGH QUALITY IMAGES WITH MAGNETIC DEVELOPER COMPOSITION

[75] Inventors: John F. Knapp, Fairport; Robert J. Gruber, Pittsford; Lawrence Floyd, Jr.; Steven B. Bolte, both of Rochester; Michael G. Swales, Sodus, all of N.Y.

[73] Assignee: Xerox Corporation, Stamford, Conn.

[ * ] Notice: The portion of the term of this patent subsequent to Sep. 2, 2003 has been disclaimed.

[21] Appl. No.: 865,327

[22] Filed: May 21, 1986

[51] Int. Cl.[4] ..... G03G 13/00; G03G 9/10

[52] U.S. Cl. ..... 430/32; 430/39; 430/110; 430/122

[58] Field of Search ..... 430/39, 122, 108, 107, 430/110, 32

[56] References Cited

U.S. PATENT DOCUMENTS

| | | | |
|---|---|---|---|
| 3,876,610 | 8/1975 | Timmerman et al. | 260/42.21 |
| 3,969,251 | 7/1976 | Jones et al. | 252/62.1 P |
| 4,272,600 | 6/1981 | Supula et al. | 430/106 |
| 4,342,822 | 8/1982 | Hosono et al. | 430/97 |
| 4,565,765 | 1/1986 | Knapp et al. | 430/122 |
| 4,609,603 | 9/1986 | Knapp et al. | 430/122 |

*Primary Examiner*—John L. Goodrow

*Attorney, Agent, or Firm*—E. O. Palazzo

[57] ABSTRACT

Disclosed is a process for generating consistent high quality images comprised of (1) providing a xerographic imaging or printing apparatus; (2) adding thereto a stable two component developer composition comprised of toner composition with an average particle diameter of from about 6 to about 10 microns with resin particles, first pigment particles, second magnetite pigment particles, which are present in a greater amount than the first pigment particles, and blended flow additive particles; and carrier particles consisting of a ferrite core, or a steel core, and a coating thereover selected from the group consisting of terpolymers of styrene, methacrylate, and triethoxysilane; and polymethacrylate, which coating has incorporated therein conductive particles; (3) forming electrostatic latent images or magnetic images in the apparatus; and (4) developing the images formed.

29 Claims, No Drawings

PROCESS FOR ULTRA HIGH QUALITY IMAGES WITH MAGNETIC DEVELOPER COMPOSITION

BACKGROUND OF THE INVENTION

This invention is generally directed to the use of specific toner and developer compositions, and more specifically, the present invention is directed to processes for generating images of outstanding consistent quality and reduced noise characteristics for substantially an unlimited number of imaging cycles with a two component magnetic developer composition. Specifically, there is provided in accordance with the present invention processes for generating prints of high quality with two component magnetic developer compositions that retain their triboelectric charging characteristics for in excess of 1.5 million imaging cycles. Also, the developer compositions selected for the present invention are useful for accomplishing the continuous unlimited development of electrostatic latent images. Thus, the two component designed developer compositions of the present invention are specifically useful in xerographic printing processes, inclusive of those embodied by the commercially available Xerox Corporation 9700®, 9500® and 5600® imaging apparatuses. With these processes the prior art problem of obtaining outstanding developed images for extended time periods is eliminated when using the developer compositions of the present invention. Also, the unique two component developer compositions of the present invention possess stable triboelectric charging characteristics for the entire imaging sequence, a property not achievable with many of the compositions of the prior art. Further, there is reduced machine maintenance, and improved admixing with the developer compositions of the present invention. Moreover, in accordance with the process of the present invention, wherein the average diameter of the toner particles selected are from about 6 to about 10 microns there is obtained improved xerographic print quality with reduced background deposits. Additionally, use of the superior unique developer compositions of the present invention enable other outstanding characteristics as disclosed hereinafter.

Numerous prior art patents are in existence directed to magnetic toner compositions. For example, there is disclosed in U.S. Pat. Nos. 3,239,465 xerographic toner particles comprised of a resinous binder and a ferromagnetic material. Specific magnetic substances selected for the toner of this patent include magnetic iron, nickel iron alloys, nickel-cobalt-iron alloys, and magnetic oxides. One disadvantage associated with the magnetic toner composition of this patent, which problem is solved with the two component developer composition of this invention, resides in achieving more efficient transfer of the developed images for extended time periods. Also, the toner composition of this patent does not retain its charging properties for an extended number of imaging cycles.

Additionally, there is disclosed in U.S. Pat. Nos. 3,345,294 and 4,082,681, toner compositions with magnetic components therein. In the '294 patent there are illustrated toner compositions with certain resin particles, magnetic substances, inclusive of magnetic iron oxides, ferroferric oxide powders, and a magnetic metal, or an alloy. The '681 patent discloses magnetic developers with a magnetic material, and finely divided conducting substances such as conductive carbon black particles. Moreover, there is disclosed in U.S. Pat. No. 4,288,519 a dual purpose single component conductive magnetically attractive toner comprised of a mixture of thermoplastic resins, finely divided magnetic pigments, and conductive pigments, Also, there is described in copending application U.S. Ser. No. 566,754, the disclosure of which is totally incorporated herein by reference, two component developer compositions comprised of polyester toner resin particles, about 20 to 50 percent by weight of magnetite, and carrier particles consisting primarily of a steel core coated with a terpolymer resin.

The developer compositions of the referred to copending application enable smudge resistance images, and prevent unwanted deposition of toner particles in a xerographic imaging apparatus. Furthermore, disclosed in U.S. Pat. No. 4,517,268 are processes for generating documents, such as checks, with two component developer compositions comprised of magnetite, certain resin particles, and carrier particles consisting of ferrite cores coated with polymeric compositions, inclusive of terpolymer compounds.

Furthermore, there is disclosed in copending application U.S. Ser. No. 681,777, now U.S. Pat. No. 4,609,603 entitled Process for Achieving Consistent High Quality Images With Magnetic Developer, the disclosure of which is totally incorporated herein by reference, a process for generating consistent high quality images for extended periods, consisting essentially of (1) providing a xerographic imaging, or printing apparatus; (2) adding thereto a stable two component developer composition comprised of resin particles, first pigment particles, second magnetite pigment particles, which are present in a greater amount than the first pigment particles, and blended flow additive particles; and carrier particles consisting of a ferrite core or a steel core, and a coating thereover selected from the group consisting of terpolymers of styrene, methacrylate, and triethoxysilane; and polymethacrylate, which coating has incorporated therein conductive particles; (3) forming electrostatic latent images, or magnetic images in the apparatus; and (4) developing the images formed, wherein the developer composition retains its electrical properties for over 2.5 million imaging cycles. The process of the present invention is similar to that described in the aforementioned copending application with the primary exception that with this invention there are selected toner particles with an average diameter of 6 to 10 microns, contrary to the prior art which teaches that the elimination by size classification of toner particles with a diameter of, for example, less than 10 microns dramatically reduces process stability and developer life.

Therefore, while many of the prior art magnetic toner compositions are sufficient for their intended purposes, there remains a need for imaging processes with improved two component magnetic toners that enable a reduction in xerographic noise characteristics. Also, there is a need for stable two component developer compositions that will enable the generation of developed images with exceptional quality; and further that will maintain their triboelectric charging characteristics for substantially unlimited imaging cycles. Furthermore, there is a need for imaging processes with two component magnetic developers that have improved aging characteristics in xerographic printing systems. Aging, a prevalent problem in many xerographic imaging processes, involves, for example, a continuous reduction in toner charging capability, which eventually causes copy quality degradation as evidenced, for example, by excessive background printout. The use of the two component magnetic developer compositions of the present invention enables these difficulties to be eliminated in that aging is reduced significantly; and images of excellent quality are generated for substantially unlimited imaging and printing cycles.

Accordingly, the present invention enables xerographic imaging and printing processes with a two component magnetic developer composition that retains its triboelectric properties; and in particular its triboelectric charging values for an extended number of imaging cycles, exceeding 1.5 million, for example, while also preventing machine contamination, and thus enabling the production of consistent high quality images. In contrast, in many prior art processes with similar developer compositions, the triboelectric charge typically undesirably decays continuously up to from about 500,000 to 1 million imaging cycles. There is also reduced machine maintenance when using the developer compositions of the present invention, and increased copy quality maintainability. With the two component developer compositions of the present invention there is also decreased machine down time, an essential characteristic for users., Additionally, with the process and developer compositions of the present invention, the prior art problem of machine down time is also overcome. These and other needs are achievable with the process of the present invention wherein there is selected specific toner and developer compositions, and wherein the diameter of the toner particles are from about 6 to about 10 microns, thereby further enabling improved image quality.

SUMMARY OF THE INVENTION

It is an object of the present invention to provide toner and developer compositions that enable ultra high xerographic print quality while simultaneously being stable over extended copying cycles.

In another object of the present invention there are provided magnetic compositions which are useful for causing the development of electrostatic latent images.

In yet another object of the present invention there are provided processes for obtaining images of consistent ultra high quality for an extended number of imaging cycles with a two component developer composition.

In yet still another object of the present invention there are provided processes for obtaining images of consistent high quality for extensive time periods with a two component developer composition that retains its triboelectric charging values.

A further object of the present invention is to provide imaging processes with two component developer compositions comprised of first pigments, second pigments, toner resin particles, flow aid additives and carrier particles of reclaimed ferrite with certain coatings thereover, and conductive particles therein.

A still further object of the present invention is to provide printing processes with two component developer compositions comprised of first pigments, second pigments, flow aids, toner resin particles, and carrier particles of ferrite with certain coatings thereover, and conductive particles therein.

In yet a further object of the present invention there are provided imaging processes with two component developer compositions that enable reduced machine contamination, and less machine down time while allowing the generation of developed images of outstanding resolution, that are readily transferable to paper substrates, for in excess of 1.5 million imaging cycles.

Furthermore, in another object of the present invention there are provided processes with two component magnetic developer compositions which prevent (1) excessive edge raggedness for parallel/perpendicular fidelity; (2) unfaithful halftone production; (3) poor halftone dot development; and (4) reduced resolution; and wherein the toner particles are of an average diameter of from about 6 to about 10 microns.

These and other objects of the present invention are accomplished by providing a process for affecting development of images with a stable two component developer composition which maintains its triboelectric charging characteristics, and desirable development properties for substantially unlimited imaging cycles. The two component developer composition selected is comprised of resin particles, first pigment particles, second pigment particles comprised of magnetite, and flow additives, and carrier particles consisting of ferrite or steel cores with specific coatings thereover; and wherein the toner composition comprised of resin particles, pigment particles, and flow additives are of an average diameter of from about 6 to about 10 microns. More specifically, there is provided in accordance with the present invention imaging and printing processes with two component magnetic developer compositions comprised of toner resin particles selected from the group consisting of styrene butadiene polymers, styrene acrylates, and styrene methacrylate copolymers, first pigment particles of carbon black, or similar materials; second pigment particles of magnetite present in a greater amount than the first pigment particle; flow additives, which in an embodiment of the present invention are considered optional components; and carrier particles consisting of ferrite cores with a coating thereover of a terpolymer of styrene, methacrylate, and vinyltriethoxysilane, or polymethacrylate having incorporated therein conductive particles; and wherein the toner composition particles are of an average diameter of from about 6 to about 10 microns.

In one specific embodiment of the present invention there is provided an improved imaging or printing process with magnetic developer compositions comprised of a toner composition with from about 70 percent by weight to 80 percent by weight of styrene butadiene toner resin particles; from about 1 percent by weight to 6 percent by weight of carbon black particles; from about 15 percent by weight to 25 percent by weight of magnetite particles; silica flow additives in an amount of from about 0.1 percent to 1.0 percent by weight of the resin particles, which toner composition particles are of an average diameter of from about 6 to about 10 microns; and carrier particles consisting of a core of ferrites, inclusive of reclaimed ferrites, coated with a terpolymer of styrene, methacrylate, and a vinyltriethoxysilane, which coatings have incorporated thereon carbon black particles. These developer compositions, which can be comprised of from about 1 to about 5 parts by weight of toner, to about 100 parts by weight of carrier particles, maintain their triboelectric stability, that is the triboelectric charge on the toner composition will be, for example, from about 20 microcoulombs per gram to 25 microcoulombs per gram for 1.5 million imaging, or printing cycles, while enabling the generation of outstanding consistent high quality images.

Therefore, in accordance with a specific preferred embodiment of the present invention there is provided a process for obtaining images of high quality by affecting development thereof with the table two component developer composition illustrated herein. This process involves (1) providing a xerographic imaging, or printing apparatus; (2) adding thereto the two component developer composition illustrated herein with, for example, a triboelectric charge of from about 20 to about 25 microcoulombs per gram, for 1.5 million imaging cycles; and (3) followed by forming and developing electrostatic latent images, or magnetic images therein.

With further regard to the two component developer compositions illustrated herein, the triboelectric charge on the toner can be from about 8 to about 30 microcoulombs per gram; however, other values may be suitable depending on the conductivity of the carrier selected. This conductivity is dependent primarily on the concentration of the conductive particles, such as Vulcan carbon blacks, dispersed in the coating present on the carrier particles; the concentration of the first pigment particles, such as carbon black, incorporated into or dispersed in the toner compositions; and the concentration of the silica flow additives which are dispersed in the resin particles. Specifically, with regard to the carrier particles selected, their conductivity is from about $10^{-9}$ to about $10^{31\ 6}$ (ohm-cm)-1, at 200 volts as measured in accordance with the procedure as described in copending application U.S. Ser. No. 227,003, the disclosure of which is totally incorporated herein by reference. Further, from about 15 percent by weight to about 30 percent by weight, and preferably about 20 percent by weight of carbon black or similar particles are included in the carrier coating. Coating weights are from about 0.3 to about 1 percent, and preferably about 0.6 percent are preferred. In one specific important embodiment of the present invention, the imaging process selects a carrier at a 0.6 percent coating weight.

Illustrative examples of suitable toner resins selected for the toner and developer compositions of the present invention include diolefins such as styrene butadiene polymers, styrene methacrylates, styrene acrylates, and styrene acrylonitriles. The preferred toner resins are styrene butadiene polymers, especially those as prepared by suspension polymerization, reference U.S. Pat. No. 4,558,108, the disclosure of which is totally incorporated herein by reference. One particularly preferred toner resin is comprised of about 85 to about 90 percent by weight of styrene, and from about 10 to about 15 percent by weight of butadiene. Additionally, styrene butadiene resins prepared by an emulsion polymerization process as disclosed in U.S. Pat. No. 4,469,770, the disclosure of which is totally incorporated herein by reference, can be selected as toner resins for the developer compositions illustrated herein.

Numerous well known suitable first pigments or dyes can be selected including, for exmaple, carbon black, nigrosine dye, and mixtures thereof. These pigments, which are preferably comprised of carbon black, function to enhance the color of the toner composition; and also assist in controlling the triboelectric charging characteristics of the resulting developer composition. Generally, the pigment particles are present in amounts of from about 1 percent by weight to about 6 percent by weight, based on the total weight of the toner composition; however, lesser or greater amounts of pigment particles can be selected providing the objectives of the present invention are achieved.

The second pigment particles are comprised of magnetites, that is a mixture of iron oxides (FeO.Fe2O3) including those commercially available as Mapico Black, MO-4232, a magnetite available from Pfizer Pigment Company; K-378, a magnetite available from Northern Pigments Corporation; and mixtures thereof. These second pigment particles are present in the toner composition in an amount of from about 15 percent by weight to about 40 percent by weight, and preferably in an amount of from about 15 percent by weight to about 20 percent by weight; however, lesser or greater amounts of the second pigment particles can be selected providing the objectives of the present invention are achieved.

Also of importance with respect to the process of the present invention is the presence of additive particles surface coated on the toner composition. These additive particles, which function primarily as flow aids, are added in an amount of from about 0.1 percent to 1.0 percent by weight of the toner resin particles. Examples of additives include colloidal silicas, such as Aerosil R972 or equivalent substances, reference for example U.S. Pat. No. 3,983,045, the disclosure of which is totally incorporated herein by reference.

Carrier particles that can be selected for mixing with the toner compositions of the present invention include specific substances, that is, those that will enable the process to the present invention. Accordingly, the carrier particles are selected from those consisting of cores of steel; iron ferrites, inclusive of the ferrites described in U.S. Pat. No. 3,914,181, the disclosure of which is totally incorporated herein by reference; and reclaimed ferrites, with coatings thereover of terpolymers of styrene methacrylate, and organo vinyltriethoxysilane, the disclosure of which is totally incorporated herein by reference; and polymethacrylates. Other carrier particles not specifically disclosed herein can be selected providing the objectives of the present invention are achieved. Moreover, it is important with respect to the imaging and printing processes of the present invention that the carrier coatings have incorporated therein carbon black; or other similar conductive pigments, in an amount of, for example, from about 15 to 30 percent by weight.

The diameter of the carrier particles can vary, however, generally this diameter is from about 50 microns to about 250 microns allowing these substances to possess sufficient density and inertia to avoid adherence to the electrostatic images during the development process. The carrier particles can be mixed with the toner composition in various suitable effective combinations including, for example, about 1 part per toner to about 10 parts to about 200 parts by weight of carrier, and preferably from about 1 to about 5 parts by weight of toner to about 100 parts by weight of carrier particles.

Also, the toner compositions of the present invention can be prepared by a number of known methods including melt blending the toner resin particles, first pigment particles, and second pigment particles, followed by mechanical attrition. The additive silica particles are then blended onto the toner composition. Other methods include those well known in the art. Toner compositions prepared in this manner result in a negatively charged toner composition in relation to the carrier materials selected, and these materials exhibit the improved properties as mentioned hereinbefore.

The toner and developer compositions of the present invention may be selected for use in developing images in electrostatographic imaging systems containing therein photoreceptors that are, for example, capable of being charged positively; or in discharge area development of photoreceptors, which are capable of being charged negatively. Examples of photoreceptors that can be selected for these imaging systems include selenium; selenium alloys, inclusive of selenium arsenic, selenium tellurium, selenium-arsenic-tellurium; halogen doped selenium compositions; halogen doped selenium alloys; hydrogenated amorphous silicon; layered negatively charged imaging members, reference U.S. Pat. No. 4,265,990, the disclosure of which is incorporated herein by reference; and the like.

The following examples are being supplied to further define various species of the present invention, it being noted that these examples are intended to illustrate and not limit the scope of the present invention. Parts and percentages are by weight unless otherwise indicated.

EXAMPLE I

There was prepared a toner composition by melt blending at a temperature of 100° C., followed by mechanical attrition, 3 percent by weight of Black Pearls L carbon black; 20 percent by weight of the magnetite Mapico Black; and 77 percent by weight of a styrene butadiene resin; 89 percent by weight of styrene; and 11 percent by weight of butadiene, available from Goodyear Chemical Company as Pliolite. Thereafter, the resulting toner composition was classified for the purpose of removing particles smaller than five microns in diameter resulting in a toner with particles having a volume medium diameter of about 6 to 8 microns as determined by a Coulter counter. Thereafter, there is incorporated on the surface of the toner composition by blending 0.5 percent by weight of the colloidal silica Aerosil R972.

Subsequently, a developer composition was prepared by mixing 2 parts by weight of the above-prepared toner composition with 98 parts by weight of carrier particles consisting of reclaimed ferrite coated with, at 0.6 percent coating weight of a terpolymer of styrene, methacrylate, and a vinyl triethoxy silane, which coating has incorporated therein 20 percent by weight carbon black particles.

Subsequently, a triboelectric charge of about 20 microcoulombs per gram was measured on the above toner composition with a Faraday Cage Apparatus. This triboelectric charge remained substantially constant on the toner composition for 1,500,000 printing cycles in the Xerox Corporation 9700® xerographic printing fixture with an amorphous selenium photoreceptor. Also, images of high quality with solid area edges and half tones, and no background deposits, were obtained for 1,500,000 printing cycles. Visual observation indicated no contamination, that is, no deposits of black particles on the components of the 9700®.

More specifically, line graphs generated during the above printing test indicated that the toner concentration remained relatively constant, that is at 2+or −0.4 percent, for about 1.5 million printing cycles; and further, the triboelectric charge on the above toner composition was a constant 22+or −2 microcoulombs per gram beginning at 0 printing cycles, and extending to 1.5 million printing cycles.

In contrast, line graphs for a developer composition prepared in the same manner, and comprised of 90 percent by weight of toner resin particles consisting of a styrene n-butylmethacrylate copolymer, 58 percent by weight of styrene, and 42 percent by weight of n-butylmethacrylate, 10 percent by weight of carbon black particles; and carrier particles consisting of a ferrite core coated with a terpolymer of styrene, methacrylate, and vinyl triethoxy silane, 0.6 percent coating weight, indicated that the toner concentration was not constant, ranging in excess of from about 2 to about less than 1 for 1.5 million printing cycles, and being an unacceptable 0.75 to 0.6 million printing cycles. Furthermore, the triboelectric charge on this toner was from in excess of 30 microcoulombs per gram to about 10 microcoulombs per gram for a period embracing start up, that is 0 printing cycles to 0.6 million printing cycles. Specifically, the triboelectric charge on this toner composition after about 500,000 imaging cycles was an unacceptable 10.3; and there resulted, at this point and for subsequent printing cycles, images of reduced quality, that is, high background was present therein. Further, visual observation indicated that the 9700® printing test fixture used was contaminated with deposits of the toner compositions selected, that is, black particles were observed on the optics.

EXAMPLE II

A developer composition of the present invention was prepared by repeating the procedure of Example I with the exception that there was selected 3 percent by weight of the carbon black Black Pearls L, 74 percent by weight of the styrene butadiene resin, and 0.5 percent by weight of Aerosil.

Substantially similar results can be generated when this developer composition is incorporated into the Xerox Corporation 9700® printer.

EXAMPLE III

A developer composition was prepared by repeating the procedure of Example I with the exception that there was selected 6 percent by weight of Regal® 330 carbon black in place of the 3 percent by weight of Black Pearls L. When this developer composition is incorporated into the Xerox Corporation 9700® printer in accordance with the procedure of Example I, substantially similar results can be achieved.

EXAMPLE IV

A developer composition was prepared by repeating the procedure of Example I with the exception that there was selected 15 percent by weight of the magnetite Mapico Black. Substantially similar results are observable when this developer composition is incorporated into the Xerox Corporation 9700® printer in accordance with the procedure as described in Example I.

EXAMPLE V

A developer composition was prepared by repeating the procedure of Example I with the exception that there was selected 25 percent by weight of the magnetite Mapico Black. Substantially similar results are generated when this composition is incorporated into the Xerox Corporation 9700® printer in accordance with the procedure of Example I.

Other modifications of the present invention may occur to those skilled in the art based upon a reading of the present disclosure and these modifications are intended to be included within the scope of the present invention.

What is claimed is:

1. A process for generating consistent high quality images comprised of (1) providing a xerographic imaging, or printing apparatus; (2) adding thereto a stable two component developer composition comprised of a toner composition with an average particle diameter of from about 6 to about 10 microns, and comprised of resin particles, first pigment particles, second magnetite pigment particles, which are present in a greater amount than the first pigment particles, and blended flow additive particles; and carrier particles consisting of a ferrite core, or a steel core, and a coating thereover selected from the group consisting of terpolymers of styrene, methacrylate, and organosilanes; and polymethacrylate, which coating has incorporated therein conductive particles; (3) forming electrostatic latent images, or magnetic images in the apparatus; and (4) developing the images formed, wherein the developer composition retains its electrical properties for an extended number of imaging cycles.

2. A process in accordance with claim 1 wherein the toner resin particles are comprised of a styrene butadiene polymer.

3. A process in accordance with claim 1 wherein the first pigment particles are present in an amount of from about 1 to about 5 percent by weight.

4. A process in accordance with claim 1 wherein the second pigment particles are present in an amount of from about 15 to about 25 percent by weight.

5. A process in accordance with claim 1 wherein the first pigment particles are comprised of carbon black.

6. A process in accordance with claim 1 wherein the second pigment particles are comprised of magnetites.

7. A process in accordance with claim 1 wherein the additive particles are comprised of colloidal silicas.

8. A process in accordance with claim 1 wherein the carrier coating is comprised of a terpolymer of styrene, methacrylate and a vinyltriethoxysilane, at a coating weight of from about 0.1 percent to about 3 percent with conductive carbon black particles therein.

9. A process in accordance with claim 1 wherein the triboelectric charge on the toner composition remains substantially constant at from 20 to 25 microcoulombs per gram for 1.5 million imaging or printing cycles.

10. A printing or imaging method which comprises forming an image on a photoconductive member, contacting the image with the developer composition of claim 1, followed by transferring the image to a suitable substrate, and optionally permanently affixing the image thereto.

11. A method in accordance with claim 10 wherein the first pigment particles are carbon black present in an amount of from about 1 percent by weight to about 5 percent by weight.

12. A method in accordance with claim 10 wherein the second pigment particles are present in an amount of from about 15 percent by weight to about 25 percent by weight.

13. A method in accordance with claim 10 wherein the resin particles are comprised of a styrene butadiene copolymer.

14. A method for developing images which comprises forming a magnetic latent image in a xerographic printing apparatus, contacting this image with the developer composition of claim 1, followed by transferring the image to a suitable substrate, and optionally permanently affixing the image thereto.

15. A method of imaging in accordance with claim 14 wherein the first pigment particles are carbon black present in an amount of from about 1 percent by weight to about 5 percent by weight.

16. A method in accordance with claim 14 wherein the second pigment particles are present in an amount of from about 15 percent by weight to about 25 percent by weight.

17. A method in accordance with claim 14 wherein the resin particles are comprised of a styrene butadiene copolymer.

18. A method in accordance with claim 10 wherein the additive particles are comprised of colloidal silicas.

19. A process in accordance with claim 1 wherein the conductive particles are carbon black.

20. A process in accordance with claim 19 wherein the carbon black is present in an amount of from about 15 percent by weight to about 30 percent by weight.

21. A process in accordance with claim 20 wherein the carbon black particles are present in an amount of about 20 percent by weight.

22. A process in accordance with claim 7 wherein the colloidal silica is present in an amount of from about 0.1 to about 1 percent by weight.

23. A process for generating consistent high quality images comprised of (1) providing a xerographic imaging or printing apparatus; (2) adding thereto a stable two component developer composition comprised of a toner composition with an average particle diameter of from about 6 to about 10 microns, and comprised of resin particles, first pigment particles, second magnetite pigment particles, which are present in a greater amount than the first pigment particles, and blended flow additive particles; and carrier particles with a coating thereover, which coating has incorporated therein conductive particles; (3) forming electrostatic latent images, or magnetic images in the apparatus; and (4) developing the images formed.

24. A process in accordance with claim 23 wherein the carrier coating is a terpolymer of styrene.

25. A process in accordance with claim 23 wherein the conductive particles are carbon black.

26. A process in accordance with claim 23 wherein the blended flow aid additive particles are colloidal silica.

27. A process in accordance with claim 1 wherein the developer composition retains its electrical properties for 1.5 million imaging cycles.

28. A process in accordance with claim 23 wherein the developer composition retains its electrical properties for 1.5 million imaging cycles.

29. A process in accordance with claim 23 wherein the developer composition has a substantially constant triboelectric charging value of from about 20 to about 25 microcoulombs per gram.

* * * * *